United States Patent [19]

Hlavac

[11] 4,137,654

[45] Feb. 6, 1979

[54] FOOTWEAR DEVICE

[75] Inventor: Harry F. Hlavac, Mill Valley, Calif.

[73] Assignee: Sports Safety, Inc., Mill Valley, Calif.

[21] Appl. No.: 766,039

[22] Filed: Feb. 7, 1977

[51] Int. Cl.[2] ..... A43B 5/04; A43B 23/08; A43B 21/36

[52] U.S. Cl. ..... 36/119; 36/69; 36/80

[58] Field of Search ..... 36/117, 119, 58.5, 68, 36/69, 80

[56] References Cited

U.S. PATENT DOCUMENTS

| | | | |
|---|---|---|---|
| 2,086,242 | 7/1937 | Sheridan | 36/80 |
| 2,821,032 | 1/1958 | Helfet | 36/68 X |
| 3,068,872 | 12/1962 | Brody | 36/68 X |
| 3,333,353 | 8/1967 | Garcia | 36/69 |
| 3,780,454 | 12/1973 | Godwin | 36/58.5 |

*Primary Examiner*—Patrick D. Lawson
*Attorney, Agent, or Firm*—Flehr, Hohbach, Test, Albritton & Herbert

[57] ABSTRACT

A device for use in footwear to correct and prevent problems associated with the human foot. The device includes upstanding side and rear walls which are integrally joined with a lower wedge to form a heel cup that closely fits with and supports the heel bone with respect to vertical. An upper planar surface of the wedge inclines at a predetermined lateral angle for controlling contact position and movement of the heel bone during locomotion. A support anchor projects forwardly from the wedge and terminates in a pointed distal end which is located toward the medial side of the foot.

12 Claims, 3 Drawing Figures

FOOTWEAR DEVICE

BACKGROUND OF THE INVENTION

This invention relates in general to devices for use in footwear to correct and prevent foot-related problems and to correct foot abnormalities.

The anatomical bone structure in the human leg and foot is such that for many individuals foot and other problems develop from physical activities such as walking and running. Among these problems are fallen arches, ankle sprains and uneven shoe heel wear. Athletes, especially runners, develop foot-related problems such as heel spur pain or "jogger's heel," "runners's knee" and some hip and sciatic nerve conditions. In children angle of gait problems can develop, such as duck feet and pigeon-toed conditions.

In many cases the "runner's knee" syndrome is athletes can be traced directly to foot problems. The human anatomy is such that the leg bones extend inwardly from the hip joints at an angle which is generally on the order of 4° to 5° from vertical. This creates an outward tilt of each heel on the order of 4° to 5° from the floor, ground or other supporting surface. As the individual walks or runs the heel tilt condition results in an inward rolling of the heel bones about the subtalar joint below the ankle. This causes a pronating motion of the foot which is carried up through the tibia to the knee joint with resulting trauma to that joint.

A number of different orthopedic devices have heretofore been developed in attempts to correct specific foot problems. Among the relevant prior art patents is U.S. Pat. No. 2,086,242 to Sheridan which provides a foot appliance having support pads positioned to maintain alignment of the foot structure for correcting foot troubles such as fallen arches.

U.S. Pat. No. 2,255,100 to Brady provides a heel pad which is insertable into a shoe for purposes of correcting posture.

U.S. Pat. No. 3,566,486 to Conway provides a shoe having a wedge structure holding the foot in a manner to relax the calf muscles and to hold the foot in alignment with the shoe sole.

U.S. Pat. No. 2,821,032 to Helfet provides an orthopedic device for correcting deformities such as flatfootedness caused by heel eversion.

British Pat. No. 780,769 provides a device insertable into a boot or shoe to form a cup-shaped support for the heel.

Orthopedic appliances such as orthotic devices are currently used by podiatrists as specific treatment for "runner's knee." Such orthotic devices are prescribed for individual patients and are typically made by first casting a mold of heel and sole portions of the patient's foot. The mold is then used to make the orthosis with an upper surface conforming to the heel and sole contour and with a wedge placed under the heel to prevent the inward rolling. However, such orthoses do not provide stabilization and support for the heel relative to vertical, and they are relatively expensive in view of the requirement to prescribe and construct them specifically for individual patients.

OBJECTS AND SUMMARY OF THE INVENTION

It is the general object of the invention to provide a new and improved footwear device for use in preventing and correcting problems and conditions associated with the human foot.

Another object is to provide a device of the type described which will support and stabilize an individual's heel bone with respect to vertical while controlling lateral heel roll.

Another object is to provide a device of the type described which includes a heel cup and integral wedge that is insertable into and removable from a shoe or other type of footwear, or in which the heel cup and wedge are integrally combined in the construction of the footwear.

Another object is to provide a footwear device of the type described which for the general population will provide arch support, control heel contact balance and minimize ankle sprains.

Another object is to provide a footwear device of the type described which for athletes will relieve heel spur pain, control heel contact balance to prevent and resolve "runner's knee" and some hip and sciatic nerve problems, and prevent ankle sprains.

Another object is to provide a footwear device of the type described which will correct angle of gait problems such as out-toeing or in-toeing.

Another object is to provide a device of the type described which establishes an inside-the-boot cant for ski boots so that a skier can achieve better edge control.

Another object is to provide a device of the type described which will correct uneven heel wear of a shoe.

The invention in summary includes a footwear device having upstanding side and rear walls which are integrally joined at their lower margins with a horizontally extending wedge. The side and rear walls and wedge cooperate to define a heel cup which supports and stabilizes the heel bone with respect to vertical. An upper planar surface of the wedge extends at a predetermined lateral angle for controlling heel roll. The device can either be formed integral with the shoe or other footwear, or it can be insertable into and removable from the shoe. The forward end of the device forms a triangular support anchor having an apex which can partially embed into the sole of the shoe at a point which is located toward the medial side of the foot. The upper surface of the support anchor slopes downwardly from the wedge towards the apex.

DESCRIPTION OF THE PREFERRED EMBODIMENTS

Figure 1:
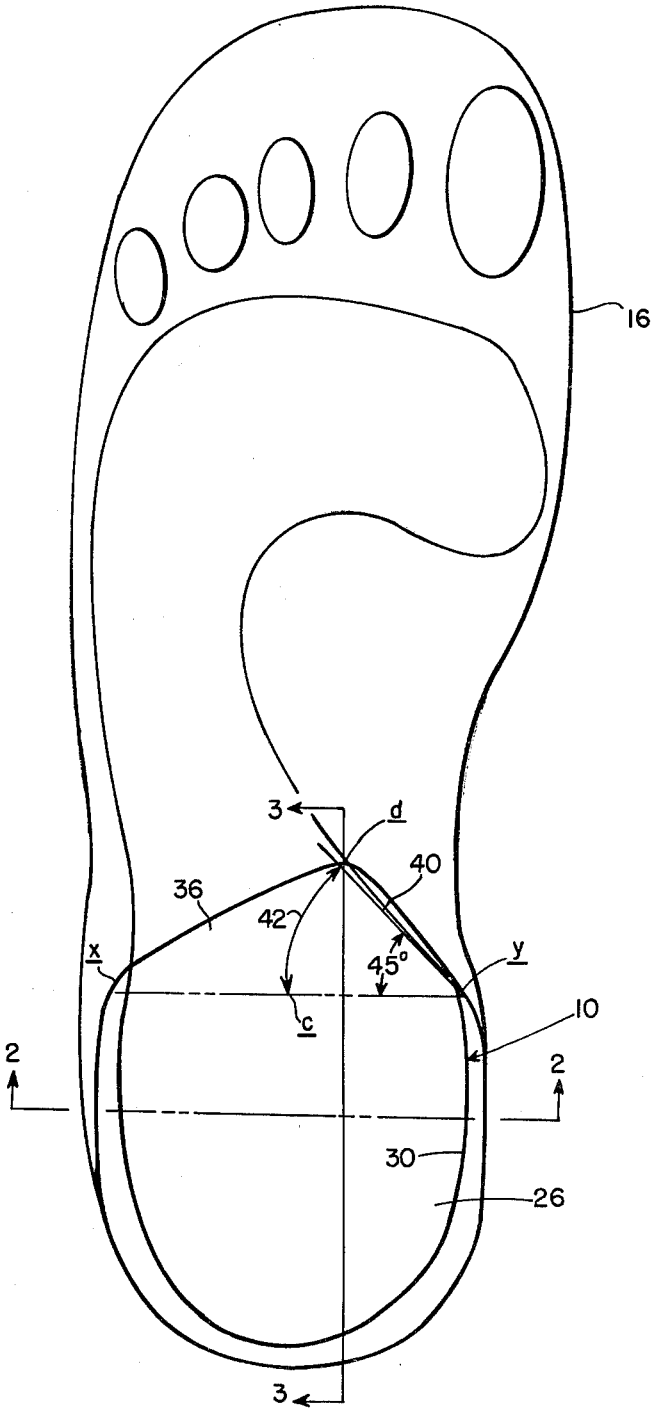
FIG. 1 is a top plan view of a device according to one embodiment of the invention shown in use with a typical left shoe.

A preferred embodiment of the invention illustrated in the drawings comprises the heel cup device 10. Device 10 is shown as especially adapted for mounting within the typical shoe 12 or other footwear to be worn on a left foot of a human, and another heel cup device, not shown, would be used by the individual within the shoe for the right foot. The right and left-handed heel cup devices are formed with complementary or mirror-image configurations.

Heel cup device 10 in the illustrated embodiment is adapted to be inserted into and removed from the shoe. The heel cup device could also be permanently mounted within the footwear as an integral part thereof, and in such case a suitable insole, not shown, could be placed over the heel cup and extend along the length of the sole.

The heel cup device of the invention is adapted for use with a wide variety of footwear types, such as dress or casual shoes, athletic shoes such as running or track shoes, or various types of special purpose shoes such as hiking boots, ski boots and the like. In the drawings the footwear is shown as a low cut shoe comprising an upper 14 mounted on a sole 16 having a heel portion 18.

The heel cup device 10 includes a generally U-shaped wall comprising a pair of upstanding laterally spaced side walls 20, 22 integral with an upstanding rear wall 24. The U-shaped wall is integral with a horizontally extending base or wedge 26. The wedge is joined at its rear and side margins with the lower margins of the side and rear walls through arcuate corners which conform generally with the contour of an individual's heel. Preferably the heel cup device is integrally molded of a suitable light-weight rigid or semi-rigid material, such as a synthetic polymer or a rubber material.

The side and rear walls and wedge 26 cooperate together to define an open cup or pocket which is sized commensurate with the heel so that a snug yet comfortable fit is provided. The invention contemplates that a range of heel cup sizes corresponding to the existing range of shoe sizes would be provided for fitting different individuals. The upper margins of the side and rear walls are of a height sufficient to extend about a midportion of the calcaneus or heel bone so that the heel is firmly supported and stabilized against angulation relative to the vertical as the individual stands, walks, runs or engages in other physical activity. The upper edges 28, 30 of the side walls curve down and forward along the sides of the calcaneus where they merge with the forward corners x, y of the wedge.

Figure 2:
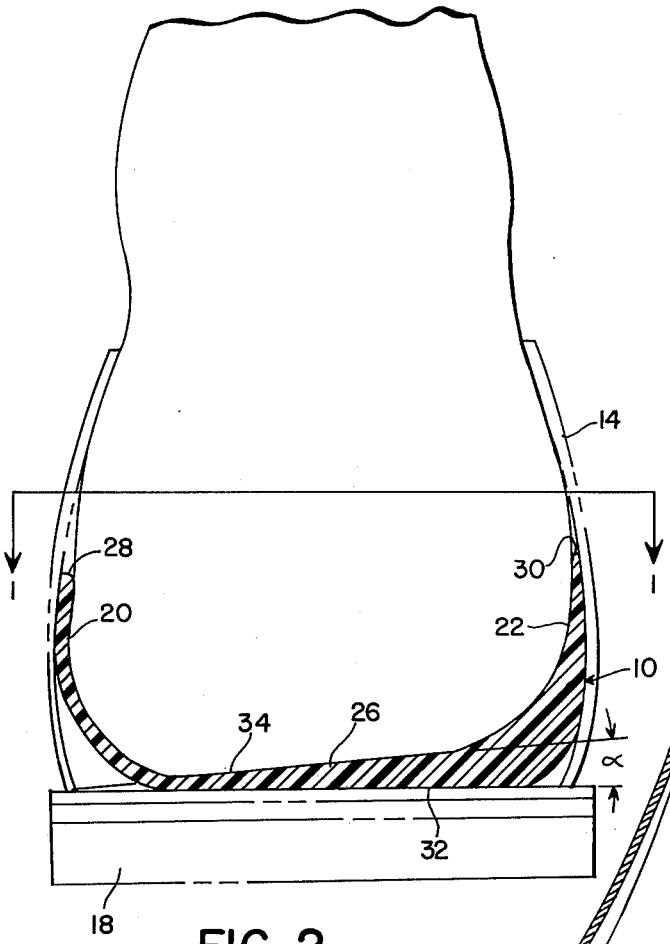
FIG. 2 is a cross-sectional view taken along the line of 2—2 of FIG. 1.

Wedge 26 is formed with a lower flat planar surface 32 which is supported on the heel portion 18 of the sole. The upper surface 34 of the wedge is planar and is canted or declined in a direction at a predetermined angle $\alpha$ from the horizontal downwardly and away from the medial portion of the foot. As shown in FIG. 2 for the illustrated left-handed heel cup device the wedge 26 provides an outwardly directed cant so as to resist inward rolling movement of the left heel. The upper surface of the wedge for the corresponding right-handed heel cup device would be angled with an oppositely-directed outward cant so that such wedge resists inward rolling of the right heel.

For use with the general population and with runners the angle $\alpha$ is in range of substantially 4°–5°, and preferably 5°. As previously explained, in the human anatomy the lower limbs extend inwardly from the hip joints at angles in the range of 4°–5° from the vertical, depending upon factors such as limb length and hip width. When walking or running the bone structure of the ankle and foot is such that the hip to leg angulation causes inward rolling of the heels. In the invention the heel cup wedge angle $\alpha$ is commensurate with the hip joint-leg angulation so as to counteract or resist the inward rolling movement of the heel during the period of heel contact to forefoot contact of the gait cycle the 4°–5° wedge angle prevents the heel bone from returning to vertical. The heel cup created by the side and rear walls of the device cooperates with the wedge so that heel balance is maintained during contact of the shoe with the supporting ground or surface and holds the heel in an inverted position of substantially 4° to 5° from the support surface during the period of heel contact to forefoot contact.

A triangular-shaped support anchor 36 is formed integral with and extends forwardly from wedge 26. As illustrated in FIG. 1 the apex d of the support anchor is located at a predetermined optimum point which lies inwardly from the longitudinal midline of the sole toward the medial side. The apex is located at the intersection of a line 40 (extending at 45° from the forward edge x-y of the wedge) with an arc 42 having a radius equal to substantially half of the distance x-y on the wedge.

When the individual's weight bears on the heel cup the pointed apex d embeds partially into the sole 16 thereby anchoring the heel cup against displacement within the shoe. The location of the anchor apex toward the medial side of the sole provides a stability function in that as the individual's weight bears on the heel cup the forward area of contact between the anchor and sole will bear a portion of this weight and assist in resisting inward rolling of the heel cup, and thereby resist inward rolling of the heel.

The provision of locating the apex of the support anchor toward the medial side of the respective left or right heel cup also functions as a direction finder aid to the user where insertable heel cups are employed. That is, by observing the location of the apex the user can identify and distinguish between the left and right heel cups so that the proper one can be placed in either the left or right shoe.

Figure 3:
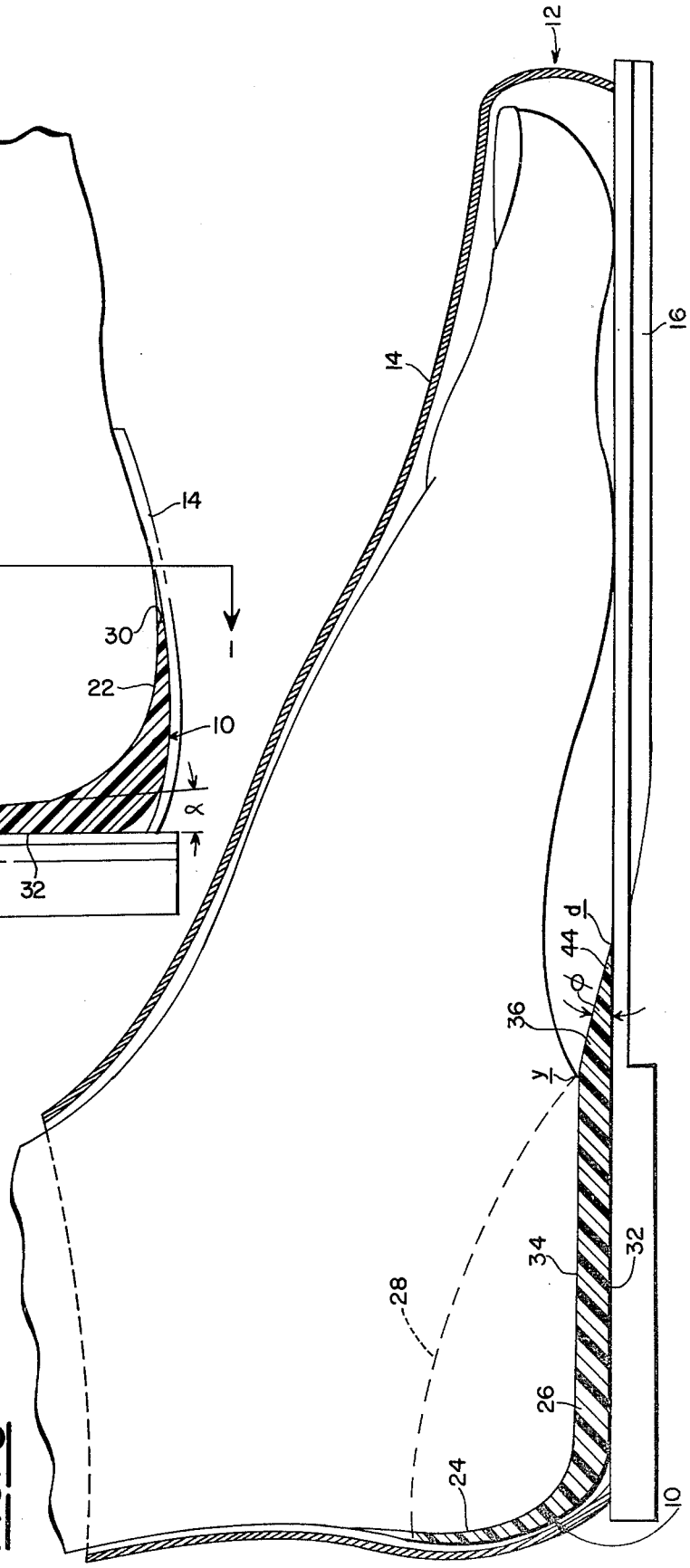
FIG. 3 is a longitudinal sectional view taken along the line of 3—3 of FIG. 1.

As shown in FIG. 3 the support anchor 36 is formed with an upper surface 44 which inclines forwardly and downwardly toward the apex d at an angle $\phi$ on the order of 9° from horizontal. The inclined surface provides positive separation of contact between the heel cup and foot sole. This serves to minimize irritation of the foot.

The use and operation of the invention is as follows. Left and right heel cups are mounted within the corresponding left and right shoes, either by insertion of the separate heel cup devices 10 or by integral construction with the footwear. The apexes d of the support anchors embed into the shoe sole and serve to stabilize the heel cup against rolling movement within the shoe. As the user walks or runs his heel is firmly supported against angulation by the side and rear walls of the heel cup, with the wedge preventing inward roll of the heel. This serves to control heel contact balance and thereby prevent and resolve conditions such as "runner's knee," and some hip sciatic nerve problems. Stabilization of the heel will also prevent or decrease ankle sprains, and correct uneven shoe heel wear. Heel cup devices 10 provide arch support by preventing collapse of the foot arch with weight bearing. Eversion or tilting of the heel can change the foot arch. Stabilization of the heel through use of the heel cup devices will obviate this problem.

In another application of the invention an inside-the-boot cant is provided for ski boots. Heel cup devices similar to that shown in FIGS. 1–3 are formed with the wedge upper surfaces inclining downwardly and outwardly at an angle in the range of 3° to 7°. This outward cant enables the skier to more effectively transfer weight to the inside edge of the ski for edge control without the requirement of cant devices which would otherwise be attached to the outside of the boot or to the top of the ski.

Heel cup devices of the invention will also find application in correcting angle of gait problems in adolescents and other with flexible feet. Heel cup devices similar to that shown in FIGS. 1–3 are formed with the wedge upper surface inclined in the direction required to produce the desired angle of gait change in the foot. For correcting "out-toeing" problems the wedge surfaces would be inclined downwardly and inwardly, and for correcting "in-toeing" problems the wedge surfaces would be inclined downwardly and outwardly. The wedge angle is commensurate with angle of gait change which is desired. For example, where the foot toes out 5° more than normal then an inside wedge angle of 5° would be provided to correct the out-toeing.

While the foregoing embodiments are considered to be preferred it is understood that numerous variations and modifications may be made therein by those skilled in the art and it is intended to cover in the appended claims all such variations and modifications as fall within the true spirit and scope of the invention.

What is claimed is:

1. For use in footwear for a human foot, a device having a pair of upstanding laterally spaced side walls and an upstanding rear will integral therewith, a horizontally extending wedge integrally joined at its side edges with the lower margins of the side walls and integrally joined at its rear edge with the lower margin of the rear wall, said wedge having an upper surface which extends along a lateral declination in the range of substantially 4° to 5° from a horizontal supporting surface for controlling lateral angulation in frontal plane movement of the heel bone during locomotion, said side walls, real wall and wedge cooperating to define a cup-shaped pocket which is sized commensurate with the heel bone whereby during said locomotion the heel is held and stabilized in the pocket in an inverted position of substantially 4° to 5° from the supporting surface from heel contact to forefoot contact during the gait cycle.

2. A device as in claim 1 in which the wedge includes means for forming a support anchor having a distal end extending in a direction forward of the wedge with the distal end being adapted to engage with the footwear for resisting displacement of the device therein.

3. A device as in claim 2 in which the support anchor includes an upper surface extending in a direction forward and downward from the upper surface of the wedge to provide for positive separation of the foot from the wedge surface.

4. A device as in claim 1 in which the side and rear walls extend upwardly about the midportion of the heel of the foot whereby the side and rear walls provide said heel support and stabilization by resisting angulation of the heel bone with respect to vertical during locomotion.

5. A device insertable into and removable from a shoe or other footwear, the device comprising a base together with an upstanding wall which is generally U-shaped in plan, said wall being joined with the upper side and rear margins of the base to define a forwardly open heel cup for stabilizing the heel bone of the foot against lateral angulation in frontal plane movement, said base having an upper planar surface which declines laterally at an angle from the horizontal in the range of substantially 4° to 5° from a horizontal supporting surface to hold the heel bone in an inverted position of substantially 4° to 5° from the supporting surface from heel contact to forefoot contact during the gait cycle.

6. A device as in claim 5 in which the base includes a forwardly projecting anchor portion having an apex which when inserted in the shoe engages the sole thereof for anchoring the device in the shoe against displacement and which anchor portion stabilizes the device against the tendency of the heel bone to roll in the heel cup.

7. A device as in claim 5 in which said upper planar surface of the base lies substantially in a plane which includes downwardly and outwardly from the medial portion of the foot to resist inward rolling of the heel bone.

8. Footwear including the combination of a sole having a heel portion, an upper mounted over the sole, means forming an upstanding, generally U-shaped wall within the upper over the heel portion of the sole, a base joined with and extending between the lower margins of the wall to define therewith an upwardly and forwardly open heel cup for stabilizing the heel bone against lateral angulation in frontal plane movement, said base having an upper planar surface which declines in a lateral direction at an angle from the horizontal in the range of substantially 4° to 5° from a horizontal supporting surface whereby the heel bone is held in an inverted position of substantially 4° to 5° from the supporting surface from heel contact to forefoot contact during the gait cycle.

9. The invention of claim 8 in which the sole and upper comprise a ski boot, and said heel cup provides support to enable the user to transfer weight to the inside of the ski boot for edge control of a ski attached thereto.

10. For use in footwear for a human foot, a device having a pair of upstanding laterally spaced sidewalls and an upstanding rear wall integral therewith, a horizontally extending wedge integrally joined at its side edges with the lower margins of the sidewalls and integrally joined at its rear edge with the lower margin of the rear wall, said wedge having an upper surface which extends along a predetermined lateral inclination for controlling movement of the heel bone during locomotion, said sidewalls, rear wall and wedge cooperating to define a cup-shaped pocket which is sized commensurate with the heel bone whereby the heel is supported and stabilized in the pocket in a fixed orientation relative to the wedge upper surface and to vertical, said wedge including means for forming a support anchor having a distal end extending in a direction forward of the wedge with the distal end being adapted to engage with the footwear for resisting displacement of the device therein, said support anchor being in the shape of a triangle in plan with the forward apex of the triangle defining said distal end, and with the distal end being located toward the medial side of the foot relative to the longitudinal midline of the footwear to provide stability for the device within the footwear against the tendency of the heel to roll in the pocket.

11. A device as in claim 10 in which said apex is located at the intersection of a line extending horizontally outwardly at substantially 45° from the forward inside edge of the wedge and an arc centered on said edge and having a radius substantially one-half of the distance between the forward edges of the wedge.

12. A device insertable into and removable from a shoe or other footwear, the device comprising a base together with an upstanding wall which is generally U-shaped in plan, said wall being joined with the upper side and rear margins of the base to define a forwardly open heel cup for stabilizing the heel bone in the foot with respect to vertical, said base having an upper planar surface which inclines laterally at a predetermined angle from the horizontal to support the heel bone at a predetermined orientation during heel contact on a supporting surface, the base including a forwardly projecting anchor portion having an apex which when inserted into the shoe engages the sole thereof for anchoring the device in the shoe against displacement and which anchor portion stabilizes the device against the tendency of the heel bone to roll in the heel cup, said apex being positioned off set toward the medial side of the device to serve as an identification aid for the user to discriminate between devices constructed for right or left shoes.

* * * * *

UNITED STATES PATENT AND TRADEMARK OFFICE

CERTIFICATE OF CORRECTION

PATENT NO. : 4,137,654

DATED : Feb. 6, 1979

INVENTOR(S) : Harry F. Hlavac

It is certified that error appears in the above-identified patent and that said Letters Patent are hereby corrected as shown below:

Column 3, line 65, after "heel" (first occurrence) insert — . —;

delete "during" and substitute "During".

Column 5, line 27, delete "will" and substitute —wall—.

Column 5, line 36, delete "real" and substitute —rear—.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*